United States Patent [19]

Johnson, Jr.

[11] 4,256,451

[45] Mar. 17, 1981

[54] UPRIGHT KILN AND ATTENDANT METHOD FOR HEATING AN AGGREGATE MATERIAL

[76] Inventor: Allen S. Johnson, Jr., P.O. Drawer 1037, Salisbury, N.C. 28144

[21] Appl. No.: 121,893

[22] Filed: Feb. 15, 1980

Related U.S. Application Data

[63] Continuation-in-part of Ser. No. 88,522, Oct. 26, 1979, Continuation-in-part of Ser. No. 95,446, Nov. 19, 1979.

[51] Int. Cl.[3] ..... F27B 15/00; F27D 1/08

[52] U.S. Cl. ..... 432/14; 34/171; 432/16; 432/96; 432/97

[58] Field of Search ..... 432/14, 15, 16, 58, 432/79, 96, 97; 34/171

[56] References Cited

U.S. PATENT DOCUMENTS

| | | | |
|---|---|---|---|
| 245,602 | 8/1881 | Barton | 34/171 |
| 2,407,636 | 9/1946 | Engler et al. | 34/171 X |
| 3,592,453 | 7/1971 | Jager | 34/79 |
| 3,692,285 | 9/1972 | Avery | 432/79 |

FOREIGN PATENT DOCUMENTS

| | | | |
|---|---|---|---|
| 277495 | 8/1914 | Fed. Rep. of Germany | 34/171 |
| 725858 | 10/1942 | Fed. Rep. of Germany | 34/171 |

*Primary Examiner*—John J. Camby

*Attorney, Agent, or Firm*—Bell, Seltzer, Park & Gibson

[57] ABSTRACT

This invention relates to a kiln of a compact upright configuration which is constructed so as to successively preheat, heat, and then cool aggregate in a continuous operation while avoiding wasteful loss of heat from the walls of the kiln or in the effluent gases. In the apparatus of this invention there is provided an upright hollow housing having an air inlet opening in a lower portion thereof and an air outlet opening in an upper portion thereof. A fan is communicatively connected to the housing for causing outside air to enter the air inlet opening and flow upwardly through the housing. A fuel burner is provided in the housing for combusting a fuel and thereby heating the air flowing upwardly within the housing. A pair of opposing gas permeable retaining walls of nonlinear zigzag configuration is positioned within the upright housing and extending generally longitudinally thereof in closely spaced relation to one another to define an elongate zigzag passageway of relatively narrow cross section adapted for receiving aggregate at the upper end and for maintaining the aggregate in the form of a relatively thin layer extending generally vertically in a series of oppositely directed downwardly inclined courses of travel.

15 Claims, 8 Drawing Figures

UPRIGHT KILN AND ATTENDANT METHOD FOR HEATING AN AGGREGATE MATERIAL

CROSS REFERENCE TO RELATED APPLICATIONS

This application is a continuation-in-part of copending U.S. application Ser. No. 088,522, filed Oct. 26, 1979 and entitled APPARATUS AND METHOD FOR TREATING AN AGGREGATE MATERIAL WITH A FLOWING GAS and U.S. application Ser. No. 095,446, filed Nov. 19, 1979 and entitled APPARATUS AND METHOD FOR HEATING AN AGGREGATE MATERIAL.

FIELD OF THE INVENTION

This invention relates to an improved apparatus and method for heating a solid aggregate material.

BACKGROUND OF THE INVENTION

In manufacturing operations involving the heating of a solid aggregate material to relatively high temperatures such as in the production of light weight aggregate or calcined limestone, the aggregate is typically processed in a rotary kiln having a horizontally extending rotatably mounted tubular body. Rotary kilns used for this purpose are typically quite massive, e.g. ten to twelve feet in diameter and fifty to a hundred feet or more in length. Because of the size of the rotary kiln and the fact that the entire tubular body thereof is mounted for rotation, the rotary kiln is quite difficult to insulate and consequently a considerable amount of the heat input to the kiln is lost through the walls thereof.

In an effort to increase the efficiency of a rotary kiln and reduce the fuel requirements, separate cooling devices have been developed for use at the discharge end of the rotary kiln for cooling the aggregate which is discharged from the kiln while transferring the heat content of the heated aggregate to the incoming air. Additionally, separate preheater devices have been developed for use on the input end of the rotary kiln for preheating the incoming aggregate by contact with the waste heated gases from the kiln.

In my copending application, Ser. No. 088,522, filed Oct. 26, 1979 and entitled APPARATUS AND METHOD FOR TREATING AGGREGATE MATERIAL WITH A FLOWING GAS, I have disclosed an improved apparatus and method for preheating solid aggregate prior to introduction to a rotary kiln. In accordance with the apparatus and method disclosed in this copending application, the aggregate is directed downwardly along a predetermined zigzag path of travel while being maintained in the form of a relatively thin layer and while the heated gases which are discharged from the kiln are directed upwardly along a predetermined sinuous path of travel repeatedly passing back and forth through the downwardly moving thin layer of aggregate from opposite sides thereof. This arrangement provides highly effective contact of the waste heated gases from the kiln with the aggregate, so as to preheat the incoming aggregate and effectively utilize the otherwise wasted heat content of the gases discharged from the kiln.

In my copending application Ser. No. 095,446, filed Nov. 19, 1979, and entitled APPARATUS AND METHOD FOR HEATING AN AGGREGATE MATERIAL, I have disclosed a related, but improved apparatus and method which provides for preheating the aggregate to a higher temperature prior to introducing the aggregate into a rotary kiln. In accordance with this application, supplemental heating means is provided within the pre-heater apparatus for further heating the waste heated gases which are discharged from the rotary kiln.

The aggregate preheater devices of my aforementioned copending applications are of simple and relatively inexpensive construction as compared to the devices previously known for this purpose, and provide for highly effective transfer of heat between the aggregate and the following gases.

SUMMARY OF THE INVENTION

In accordance with the present invention I have provided a kiln of simple and compact upright configuration which utilizes many of the principles and advantageous features of my aforementioned preheater devices. The upright kiln of this invention provides a much more efficient and much less expensive alternative to the massive rotary kilns which have been conventionally used in the heating of aggregate.

The upright kiln of this invention is constructed so as to successively preheat, heat, and then cool the aggregate in a continuous operation, while avoiding wasteful loss of heat from the walls of the kiln or in the effluent gases. The upright kiln of this invention thus avoids the need for separate preheater and cooling devices as have been used in the past in association with rotary kilns.

In accordance with the apparatus of this invention, there is provided an upright hollow housing having an air inlet opening in a lower portion thereof and an air outlet opening in an upper portion thereof. A fan is communicatively connected to the housing for causing outside air to enter the air inlet opening and flow upwardly through the housing. A fuel burner is provided in the housing for combusting a fuel and thereby heating the air flowing upwardly within the housing. A pair of opposing gas permeable retaining walls of nonlinear zigzag configuration is positioned within the upright housing and extending generally longitudinally thereof in closely spaced relation to one another to define an elongate zigzag passageway of relatively narrow cross section adapted for receiving aggregate at the upper end thereof and for maintaining the aggregate in the form of a relatively thin continuous layer extending generally vertically in a series of oppositely directed downwardly inclined courses of travel. Means is provided cooperating with the pair of retaining walls and with the surrounding housing for directing the flow of heated air within the housing successively through each of the oppositely directed downwardly inclined courses of travel of the layer of aggregate to thereby provide highly effective contact of the heated air with the aggregate for heating of the aggregate. Means is provided for discharging aggregate from the lower end of the passageway to thus cause the layer of aggregate to move downwardly along the passageway, and means is provided for supplying additional aggregate to the upper end of the passageway to thus maintain the passageway filled with aggregate.

In the method and apparatus of this invention, the force of gravity is used to move the aggregate downwardly through the elongate narrow passageway while heated air is repeatedly passed through the thin layer of aggregate to heat the aggregate to the desired temperature. This apparatus and method thus avoids the need for massive moving parts, as is required in a rotary kiln, and allows the upright housing to be efficiently insulated to avoid undesirable heat loss. The countercurrent movement of the heated layer of aggregate and the heated air, and the repeated passage of the air through the thin layer of aggregate brings about a highly efficient transfer of heat to the aggregate in the portion of the apparatus near the fuel burner, while also providing for efficient preheating of the incoming aggregate by the outgoing heated gases to thus transfer the heat content of the heated gases to the aggregate for maximum efficiency in operation.

The invention also provides for cooling of the aggregate following the heating operation, with the heated aggregate being used for preheating the incoming air being directed through the upright housing.

BRIEF DESCRIPTION OF THE DRAWINGS

Some of the features and advantages of the invention having been stated, others will become apparent as the description proceeds, when taken in connection with the accompanying drawings, in which.

DESCRIPTION OF THE ILLUSTRATED EMBODIMENTS

Figure 1:
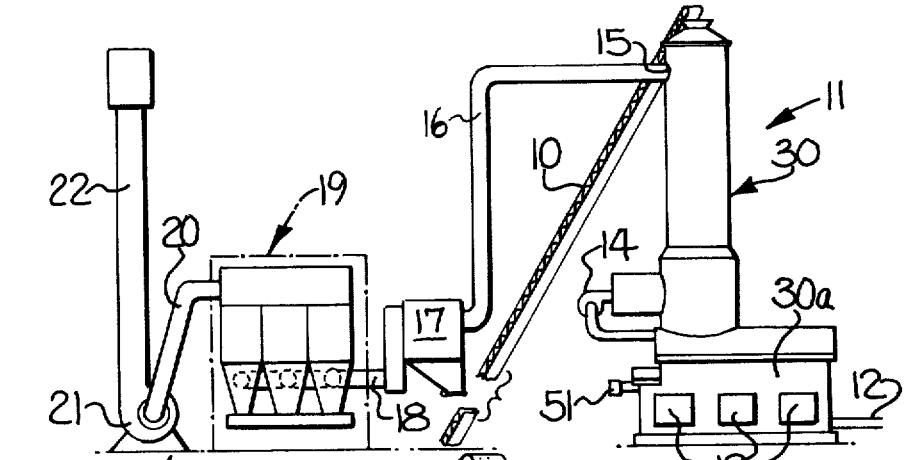
FIG. 1 is a somewhat schematic elevational view showing an assembly of apparatus for heating an aggregate material, and illustrating an upright kiln apparatus constructed in accordance with this invention.

Referring now more particularly to the drawings, FIG. 1 illustrates an assembly of apparatus for heating an aggregate material. Such an apparatus may be useful, for example, for calcining limestone, for expanding lightweight aggregate, or for roasting various other kinds of minerals or ores. The minerals or other materials which are processed through the illustrated apparatus are referred to herein by the term "aggregate," but it is to be understood that this term is not intended to be limited to a mineral or rock of any particular chemical composition. The illustrated apparatus is particularly designed for processing relatively coarse aggregate in the form of chunks of a size up to about two to three inches across, as distinguished from fine granular or powdered aggregate of a size comparable to sand, for example. The illustrated apparatus is particularly suited for processing aggregate which has been at least partially preclassified as to size, and preferably within the size range of from about three-fourths inch to about one and one-half inches.

The apparatus illustrated in FIG. 1 includes a conveyor 10 for conveying the aggregate from a supply source, not shown, to the upper end of an upright kiln, generally indicated by the reference character 11. The aggregate passes downwardly through the kiln 11, in a manner to be described more fully hereinafter, and is removed from the lower end of the kiln on a suitable conveyor 12. Outside air is directed into the kiln through air inlet openings 13 and flows upwardly through the kiln where it is heated by a fuel burner 14. The heated air is brought into contact with the downwardly moving aggregate in a manner to be described in more detail later so as to thus heat the aggregate to a desired elevated temperature. The air leaves the kiln 11 through an outlet opening 15 at the upper end thereof and is directed along a duct 16 to a dust collection box 17 where heavier particles of dust and other particulate matter are separated from the flowing stream. The air and combustion gases are then directed via a duct 18 to a suitable filtration apparatus, generally indicated by the reference character 19. In the embodiment of the invention illustrated, the filtration apparatus 19 is a baghouse of a type conventionally employed for removing dust and other fine particulate material from a stream of flowing gas, the baghouse containing a plurality of elongate tubular baglike filters. From the filtration apparatus 19 the gases are directed along a duct 20 through a fan 21 which serves for inducing the flow of gases through the baghouse and through the kiln 11, with the gases then being discharged to the atmosphere via a smokestack 22.

Figure 2:
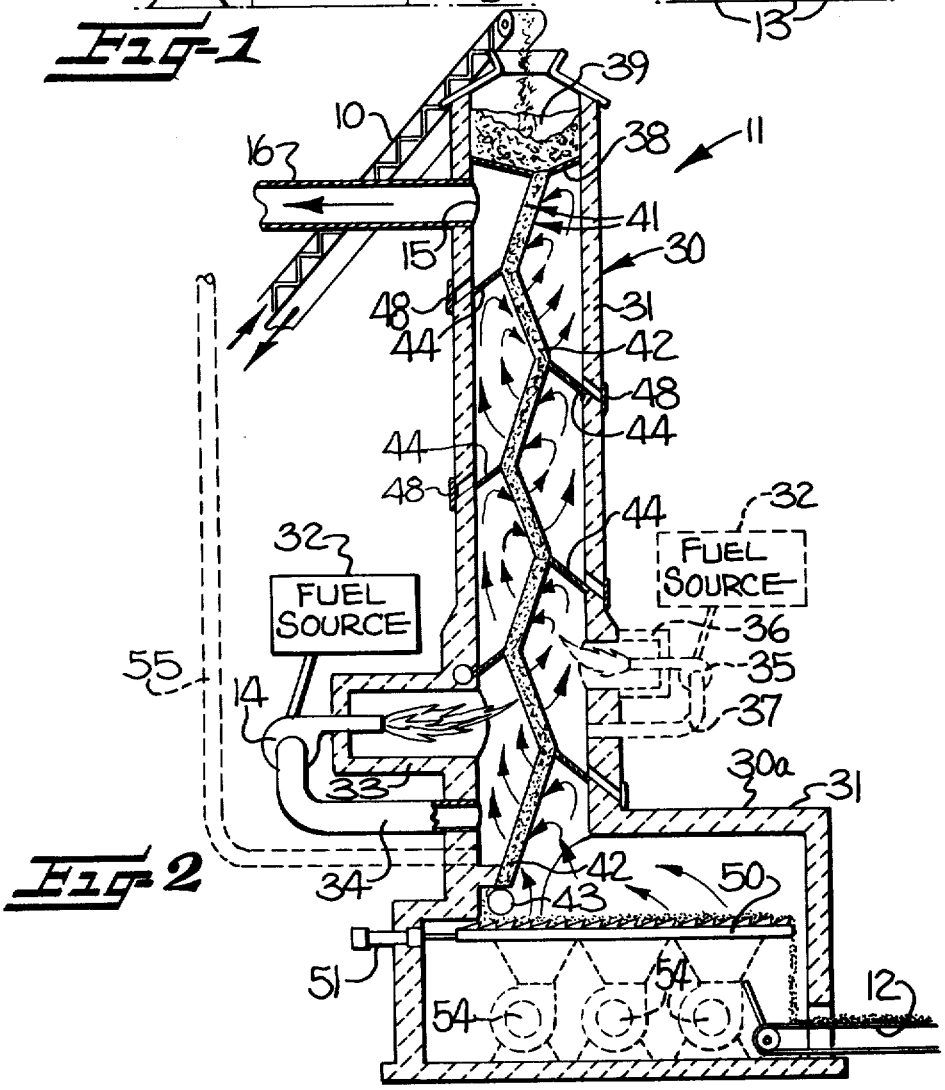
FIG. 2 is a side cross-sectional view of the upright kiln apparatus shown in FIG. 1.

As illustrated in more detail in FIG. 2, the kiln 11 inches an upright hollow housing 30, the walls of which are insulated with a layer of refractory insulating material 31. Outside air enters the hollow housing 30 through inlet openings 13 (FIG. 1) located adjacent the lower end of the housing, and the air flows upwardly through the housing, leaving the housing through the air outlet opening 15 provided adjacent the upper end of the housing. In the course of its upward flow through the housing, the air is heated by a fuel burner 14, which, in the embodiment of the invention illustrated in FIG. 2, is of a type designed for burning powdered coal or fuel oil from a suitable fuel source 32. The fuel burner 14 is mounted in a refractory insulated combustion chamber 33 forming a part of the lower portion of the housing 30. A duct 34 is provided for drawing preheated air from the interior of the hollow housing 30 for combustion with the fuel.

As indicated by the broken lines, the kiln may be optionally provided with a supplemental fuel burner 35, located generally above or upstream of the fuel burner 14 for further heating the air flowing through the hollow housing 30. As illustrated in this embodiment of the invention, the supplemental fuel burner 35 is similarly fired by powdered coal or fuel oil from a suitable fuel source 32, and is mounted in a refractory insulated combustion chamber 36. A duct 37 is provided for supplying preheated air to the burner 35 for combustion with the fuel.

A wall 38 is provided at the upper end of the housing 30 to form a storage hopper or reservoir 39 for the aggregate material which is supplied to the upper end of the kiln by the conveyor 10. Also provided within the hollow housing 30 is a pair of opposing gas permeable retaining walls, generally indicated at 41, which extend generally longitudinally within the housing 30. As illustrated, the retaining walls 41 are of a nonlinear zigzag configuration and are positioned in closely spaced relation to one another, e.g. about five to six inches apart, to define an elongate generally vertically extending zigzag pasaageway 42 of relatively narrow cross section. As illustrated, the uppermost ends of the retaining walls 41 are communicatively connected to the wall 38 so that aggregate in the reservoir 39 is directed into the upper end of the elongate zigzag passageway 42. The passageway 42 is thus adapted for maintaining the aggregate in a relatively thin continuous layer extending generally vertically in a series of oppositely directed downwardly inclined courses of travel. An elongate cylindrical roll 43 is positioned beneath the lower end of the retaining walls 41 in partially obstructing relationship to the lower end of the passageway 42 so that the passageway remains filled with aggregate. The roll 43 is rotatably driven by a drive motor for discharging the aggregate from the lower end of the passageway at a controlled metered rate. Thus, the layer of aggregate moves downwardly along the zigzag passageway 42 so as to be heated by the flowing air, with the reservoir 39 serving to insure that the passageway remains filled with aggregate.

The retaining walls 41 which form the elongate zigzag passageway 42 are of a gas permeable construction to allow the heated air and combustion gases flowing within the housing 30 freely to pass through the thin layer of aggregate. As illustrated, the arrangement of the zigzag gas permeable retaining walls 41 is such that the heated air and combustion gases flowing along the interior of the housing are repeatedly directed through the retaining walls 41 and into contact with the thin layer of aggregate located therebetween. More particularly, it will be seen that a series of imperforate baffle plates 44 extend outwardly from the retaining walls 42 at spaced locations along the longitudinal extent of the retaining walls so as to direct the flowing gases in a sinuous upward path of travel which repeatedly passes laterally back and forth through the retaining walls and thus repeatedly directs the heated gases into and through the downwardly advancing thin layer of aggregate.

Figures 3, 4, 5:
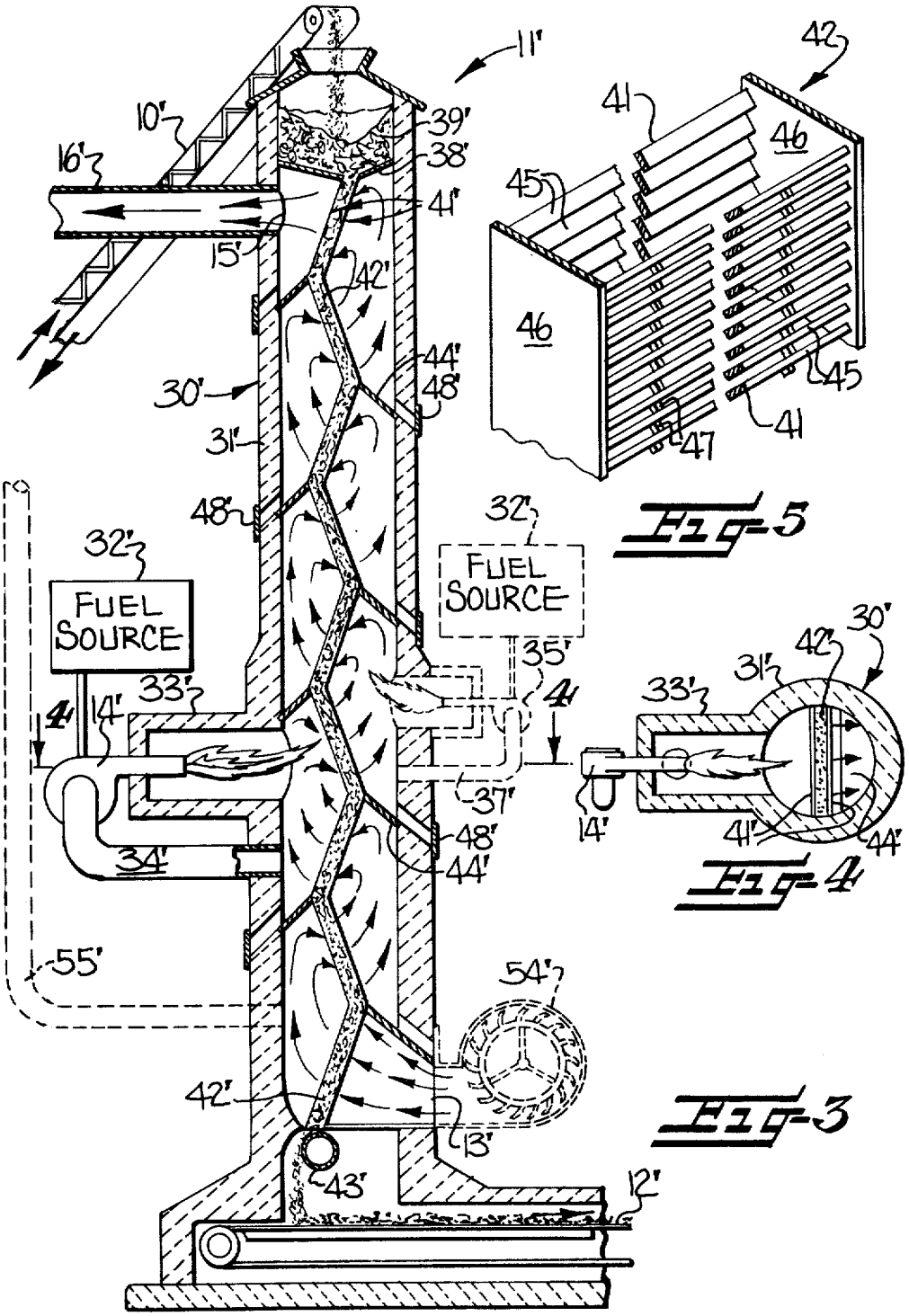
FIG. 3 is a side cross-sectional view of an alternate form of an upright kiln apparatus in accordance with this invention.
FIG. 4 is a cross-sectional view of the kiln apparatus taken substantially along the line 4–4 of FIG. 3.
FIG. 5 is a fragmentary perspective view showing the construction of the louvered retaining wall in the interior of the kiln apparatus.
Figure 6:
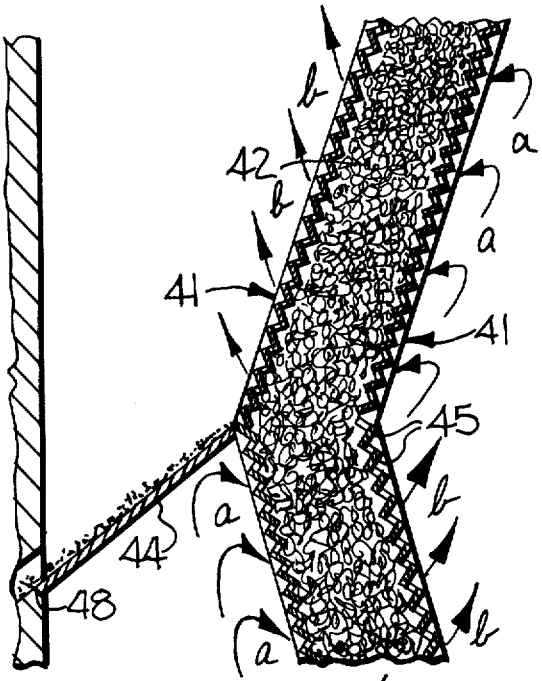
FIG. 6 is an enlarged detailed cross-sectional view showing the louvered retaining walls.

As best seen in FIGS. 5 and 6, the gas permeable retaining walls 41 which define the zigzag passageway 42 are of a louvered construction and comprised of a series of parallel laterally extending slats 45 which extend substantially the full width of the passageway and are connected to opposing solid end walls 46 (FIG. 5). The slats 45 in each series are spaced apart from one another to permit the flow of gas therebetween, with reinforcing spacers 47 being mounted between adjacent slats at spaced locations across the width thereof to provide enhanced structural rigidity to the retaining wall. As illustrated, the slats 45 are inclined angularly downwardly in the direction of movement of the aggregate and are convergingly arranged with the opposing series of slats. The slats of each series are positioned in overlapping relation to one another to assist in guiding the aggregate along its downward path of travel while confiningly retaining the aggregate within the elongate passageway 42 and while also readily permitting the flow of gas into and through the thin layer of aggregate.

The zigzag retaining walls 41 are each comprised of a series of inclined portions or segments, with each portion or segment being inclined at a relatively small angle from the vertical axis. Preferably, the angle of incline is within the range of about 10 degrees to about 25 degrees from the vertical axis, and most desirably about 17 degress to 18 degrees. The respective portions or segments which collectively define each retaining wall 41 are so arranged that alternate portions are inclined to one side of the vertical axis, with the intervening portions being inclined to the opposite side of the vertical axis. The thin layer of aggregate is thus directed laterally back and forth in opposite directions along a series of oppositely directed downwardly inclined courses of travel.

As indicated by the air flow arrows in FIG. 3, and as shown in greater detail in FIG. 6, the upward flow of the heated air and combustion gases through the respective wall portions is such that the gases always enter the thin layer of aggregate on the lower of the pair of opposing inclined wall portions, and emerge from the layer through the upper of the pair of wall portions. Thus, as indicated by the air flow arrows a in FIG. 6, the louvered construction of the retaining walls causes the heated air and combustion gases to be directed into the inclined thin layer of aggregate angularly downwardly in generally the same direction as the direction of movement of the aggregate. The flow of the gas thus assists in the downward movement of the layer of aggregate, rather than interfering with or opposing the movement of the aggregate as might occur if the gas flow passed through the layer of aggregate in a different direction. This is quite significant at the high air velocities which are preferably utilized in the upright kiln. By directing the air flow angularly through the layer of aggregate, the louvered construction of the wall also serves to increase the distance which the heated gas must travel through the layer, thus enhancing contact and heat transfer between the gas and the aggregate.

The inclined angular orientation of the wall portions is also quite significant in obtaining effective removal of the dust and other fine particulate material from the aggregate and in preventing clogging of the air passageways between the respective slats 45 as a result of accumulation of dust between the slats. This will thus be understood by again referring to FIG. 6. As illustrated, the aggregate which is located closest to the lower of the opposing pair of inclined wall portions, i.e. the wall on the inflow side where the air enters the layer of aggregate, is in a relatively compacted state since it bears the weight of the overlying aggregate. However, the aggregate which is located closest to the outflow wall, i.e. the upper of the pair of inclined opposing wall portions, does not bear the weight of the overlying aggregate but is shieldingly protected by the overlying wall and is thus more loosely compacted. This permits the looser aggregate to move and turn as it advances downwardly in the layer and permits any dust which is carried by the aggregate to be readily swept away by the outflowing current of gases. Furthermore, the slats 45 on the outflow wall are oriented angularly upwardly at a relatively steep incline and as indicated by the flow arrows b in FIG. 6 the gases are directed between the slats in an angularly upward direction. The relatively steep inclined orientation of the slats assists in keeping the air passageways between the slats clear of any accumulated dust, since the exposed surfaces of the slats are inclined too steeply for the dust to accumulate thereon and the flowing air will tend to sweep away any dust which may accumulate on the slat surfaces.

When dust or other particulate material is removed from the layer of aggregate, the heavier particles have a tendency to settle out or fall rather than being swept along with the flowing gas stream, and the dust or particulate material settles on the upper surface of the baffle plates 44. As illustrated in FIG. 2, the baffle plates are inclined downwardly from the retaining walls 41 and outwardly toward the surrounding housing 30 and thus serve for directing the dust or particulate material outwardly toward the housing 30. Since, in the illustrated embodiment, the surrounding housing 30 is of a circular cross section, the inclined baffle plates 44 are of a semi-elliptical shape and thus serve to convergingly direct the accumulated dust or particulate material to a common location at the lowest point on the baffle plate. An opening 48 is provided in the wall of the housing 30 at this location through which the accumulated dust may be removed from the housing.

Because of the zigzag construction of the retaining walls 41 and the arrangement of the baffle plates 44 the heated air and combustion gases are repeatedly directed through the thin layer of aggregate from alternate directions, i.e. first from one side of the thin layer and then from the other side thereof. Consequently, a different side or face of the aggregate is exposed to the flowing gases with each pass so as to thereby maximize the transfer of heat between the flowing gases and the aggregate.

In the lower portions of the housing 30 near the fuel burner 14, the combustion gases and the surrounding air is at a very high temperature, e.g. on the order of 1200° F. As the heated air and combustion gases flow upwardly along the interior of the housing 30 and repeatedly pass through the thin layer of aggregate, more and more of the heat content of the air is transferred to the incoming aggregate. The upper portions of the elongate zigzag passageway 42 thus serve as a preheating zone for preheating the aggregate as it advances downwardly along the passageway. Essentially all of the usable heat content of the air is transferred to the incoming aggregate prior to the air leaving the housing through the air outlet opening 15. It will thus be seen that the upright kiln arrangement in accordance with this invention makes maximum utilization of the heat input and avoids wasteful discharge of usable heat in the outgoing air.

In order to further maximize the utilization of the heat input from the fuel burners 14 and 35, the upright kiln apparatus of this invention is provided with means for cooling the aggregate after it has been heated to the desired temperature by contacting the heated aggregate with the unheated outside air which is being introduced into the hollow housing 30. This serves not only to cool the aggregate, but additionally to preheat the incoming air prior to its reaching the fuel burners. In the embodiment of the invention illustrated in FIG. 2, the aggregate cooling and air preheating means is housed in an enlarged lower portion **30*a* of the housing 30 and includes an air permeable grate 50 located for receiving the heated aggregate as it is discharged from the lower end of the elongate zigzag passageway 42. The grate 50 is mounted for reciprocating movement and so constructed as to cause the aggregate to be moved laterally there-across when the grate is reciprocated by a suitable prime mover 51. As schematically illustrated in FIG. 2, the movement of the aggregate across the grate is accomplished by means of a series of inclined pushers formed on the upper surface of the grate 50**.

To assist in drawing outside air into the housing through the air inlet openings 13 (FIG. 1) and causing the air to pass through the bed of aggregate on the grate 50, a series of fans 54 may be optionally provided beneath the grate 50 in the interior of the hollow housing 30. When used, the fans 54 serve as booster fans in association with the fan 21 for providing a flow of air upwardly through the housing 30. A vent stack 55, shown in dotted lines in FIG. 2, may be optionally provided in the housing to assist in providing a balanced flow of air when the booster fans 54 are used in addition to the fan 21.

The second embodiment of the invention illustrated in FIGS. 3 and 4 is quite similar in many respects to the embodiment previously described in detail in connection with FIGS. 1, 2, 5 and 6. To avoid repetition, elements of the upright kiln which correspond to elements previously described in connection with the previous embodiment will bear the same reference characters wherever applicable, with prime notation added.

The upright kiln 11' shown in FIG. 3 differs over the embodiment of FIGS. 1 and 2 primarily in the arrangement provided for cooling the aggregate following the heating thereof. In this embodiment, the zigzag passageway 42' which is defined by the pair of retaining walls 41' has a lower portion which extends for a substantial distance below the fuel burner 14' and thus defines a cooling zone for the aggregate. Thus, once the downwardly moving aggregate passes below the fuel burner 14', it is contacted with the outside air which is flowing upwardly through the lower portion of the housing 31'. The incoming air cools the downwardly moving aggregate in the cooling zone, and the air is preheated prior to reaching the portion of the housing where the fuel burner 14' is located. When the aggregate reaches the lower end of the zigzag passageway 42', it is discharged onto a suitable conveyor 12' which transports the aggregate to a remote location for storage or subsequent use.

Although not essential, a booster fan 54', shown in broken lines, may be optionally provided at the base of the housing 30' for assisting in directing outside air into and upwardly through the hollow housing 30'. An optional vent stack 55' also may be connected to the base of the housing to assist in balancing the air flow when fans are connected to both ends of the hollow housing 30'.

Figure 7:
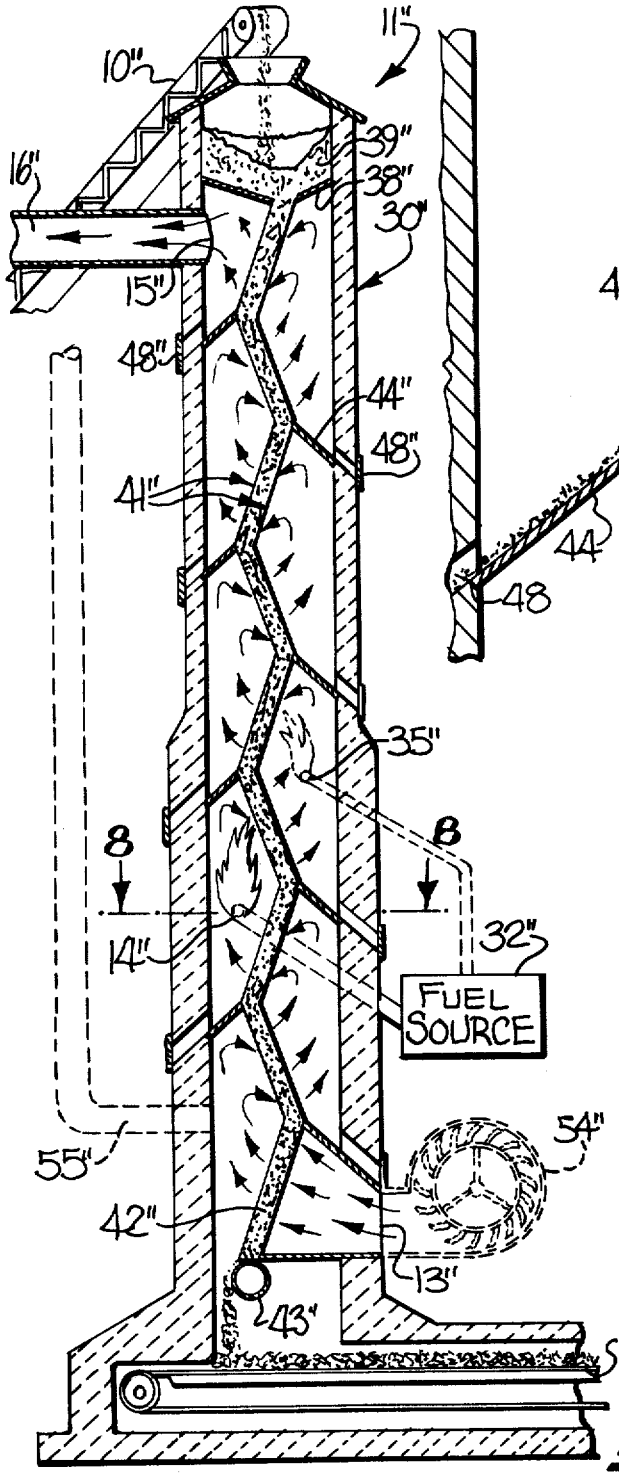
FIG. 7 is a side cross-sectional view of a further form of an upright kiln apparatus in accordance with this invention.
Figure 8:
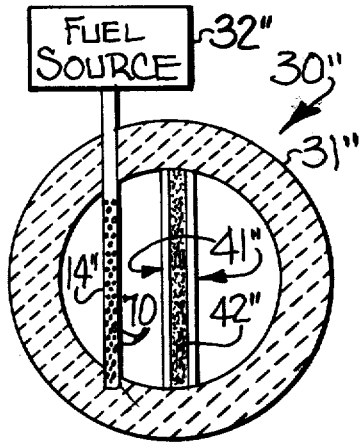
FIG. 8 is a cross-sectional view of the kiln apparatus taken substantially along the line 8–8 of FIG. 7.

A further modified form of the invention is shown in FIGS. 7 and 8. Again, to avoid repetition, elements which correspond to elements previously described in detail will be identified by corresponding reference numerals wherever applicable, with double prime notation added.

This embodiment illustrates an upright kiln constructed for using a gaseous fuel such as natural gas for heating of the aggregate. In this arrangement, there is no need for a separate combustion chamber as in the previous embodiments. Instead, the fuel burner 14" and the optional supplemental fuel burner 35" are located within the hollow housing directly in the path of flow of the upwardly moving air. As best seen in FIG. 8, the fuel burner 14" comprises an elongate tubular member having a plurality of small openings or orifices 70 provided therein for discharge of the gas or a gas-air mixture. The supplemental fuel burner 35" is of similar construction.

Although the drawings show the gas fuel burners 14" and 35" used in an upright kiln housing similar to that of FIG. 3 where the zigzag passageway 42" is constructed so as to form a cooling zone in the lower portion thereof for the aggregate, it will be appreciated that the gas fuel burners 14" and 35" also could be employed in a kiln housing of the type shown in FIGS. 1 and 2 wherein the cooling means for the aggregate is in the form of a horizontal grate located beneath the zigzag passageway.

In the drawings and specification there have been set forth preferred embodiments of the invention and although specific terms are employed they are used in a generic and descriptive sense only and not for purposes of limitation.

What is claimed is:

1. An upright kiln for heating a solid aggregate and comprising an upright hollow housing having an air inlet opening in a lower portion thereof and an air outlet opening in an upper portion thereof, means communicatively connected to said housing for causing outside air to flow upwardly through said housing, entering the housing through said air inlet opening and leaving the housing through said air outlet opening, a fuel burner provided in aid housing and operable for combusting a fuel for heating the air flowing within said housing, a pair of opposing gas permeable retaining walls of nonlinear zigzag configuration positioned within said upright housing and extending generally longitudinally thereof in closely spaced relation to one another to define an elongate generally vertically extending zigzag passageway relatively narrow cross section adapted for receiving aggregate at the upper end thereof and for maintaining the aggregate in the form of a relatively thin continuous layer extending generally vertically in a series of oppositely directed downwardly inclined courses of travel, each of said opposing gas permeable retaining walls being comprised of a series of laterally extending spaced apart slats interconnected to define inclined segmental wall portions inclined at an angle within the range of about 10° to about 25° from the vertical axis and so arranged that alternate segmental wall portions are inclined to one side of the vertical axis, with the intervening segmental wall portions being inclined to the opposite side of the vertical axis and with the slats of the opposing series being convergingly arranged and inclined angularly downwardly in the direction of movement of the aggregate and positioned in overlapping relation to one another to assist in guiding the aggregate along its downward path of travel while confining the aggregate within the passageway and while also readily permitting the flow of heated gas into and through the thin layer of aggregate, means cooperating with said pair of retaining walls and with the surrounding housing for directing the flow of heated air within said housing successively through each of said oppositely directed downwardly inclined courses of travel of the layer of aggregate so as to flow laterally back and forth through the thin layer of aggregate from opposite sides thereof to provide highly effective contact of the heated air with the aggregate for heating of the aggregate, means for discharging aggregate from the lower end of said passageway to thus cause the layer of aggregate to move downwardly along said passageway, and means for supplying aggregate to the upper end of said passageway to thus maintain the passageway filled with aggregate.

2. An upright kiln as set forth in claim 1 including a combustion chamber provided in said housing, and wherein said fuel burner is located in said combustion chamber.

3. An upright kiln as set forth in claim 1 including an additional fuel burner provided in said housing above said first mentioned fuel burner for further heating the air as it flows upwardly within said housing.

4. An upright kiln as set forth in claim 3 including respective combustion chambers provided in said housing, and wherein said recited fuel burners are located in said respective combustion chambers.

5. An upright kiln as set forth in claim 1 wherein said means for causing outside air to flow through said housing comprises a fan communicatively connected to said outlet opening for drawing air from said housing and discharging the air to the atmosphere, and air filter means associated with said fan for filtering the air of particulate material prior to discharge to the atmosphere.

6. An upright kiln as set forth in claim 5 wherein said means for causing outside air to flow through said housing further comprises a booster fan communicatively connected to said inlet opening of said housing and to the ambient atmosphere and operable for directing ambient outside air into said inlet opening.

7. An upright kiln as set forth in claim 1 including means within said housing for cooling the aggregate following heating thereof, said cooling means comprising a horizontally extending air permeable grate positioned for receiving the heated aggregate which is discharged from the lower end of said passageway, means for advancing the heated aggregate laterally across said grate and means for directing the outside air entering said housing through said grate and through the heated aggregate positioned thereon so as to cool the heated aggregate while preheating the air entering said housing.

8. An upright kiln as set forth in claim 1 wherein said zigzag passageway defined by said pair of opposing retaining walls has a lower portion located below said fuel burner and defining a cooling zone within said housing for cooling the heated aggregate following heating thereof, said lower portion of said zigzag passageway extending into the path of the outside air flowing upwardly through said housing toward said fuel burner for thus directing the heated aggregate in said lower portion of said passageway into contact with the upwardly flowing air so as to cool the heated aggregate while preheating the upwardly flowing air.

9. An upright kiln for heating a solid aggregate and comprising an upright hollow housing having an air inlet opening in a lower portion thereof and an air outlet opening in an upper portion thereof, insulation means provided in said housing for reducing the loss of heat therefrom, a fan communicatively connected to said outlet opening of said housing for withdrawing air from said housing and discharging the air to the atmosphere while causing outside air to enter the housing through said inlet opening and flow upwardly through the housing, air filter means associated with said fan for receiving the air withdrawn from said housing and filtering the air of particulate material prior to discharge of the air to the atmosphere, a pair of opposing gas permeable retaining walls of nonlinear zigzag configuration positioned within said upright housing and extending longitudinally thereof in closely spaced relation to one another to define an elongate generally vertically extending zigzag passageway of relatively narrow cross section adapted for receiving aggregate at the upper end thereof and for maintaining the aggregate in the form of a relatively thin continuous layer extending generally vertically in a series of oppositely directed downwardly inclined courses of travel, means cooperating with said pair of retaining walls and with the surrounding housing for directing the flow of air within said housing successively through each of said oppositely directed downwardly inclined courses of travel of the layer of aggregate so as to flow laterally back and forth through the thin layer of aggregate from opposite sides thereof to provide highly effective contact of the air with the aggregate, means for discharging aggregate from the lower end of said passageway to thus cause the layer of aggregate to move downwardly along said passageway, means defining a storage reservoir at the upper end of said zigzag passageway for maintaining the passageway filled with aggregate, means for conveying aggregate to said storage reservoir, and a fuel burner provided in said upright housing and operable for combusting a fuel for heating the air flowing within said housing, said fuel burner being located between opposite ends of said vertically extending zigzag passageway defined by said pair of retaining walls so that portions of said zigzag passageway extend above and below said fuel burner for a substantial distance, the portions of said zigzag passageway located above the fuel burner extending into the path of the air which has been heated by the fuel burner for thus heating the aggregate located in such portions of said passageway, and the portions of said passageway located below said fuel burner extending into the path of air flowing upwardly toward said fuel burner for thus cooling the heated aggregate in such portions of said passageway while also preheating the air which is flowing upwardly within said housing toward said fuel burner.

10. An upright kiln as set forth in claim 9 additionally including a booster fan communicatively connected to said inlet opening of said housing and to the ambient atmosphere and operable for directing ambient outside air into said inlet opening.

11. An upright kiln for heating a solid aggregate and comprising an upright hollow housing having an air inlet opening in a lower portion thereof and an air outlet opening in an upper portion thereof, insulation means provided in said housing for reducing the loss of heat therefrom, a fan communicatively connected to said outlet opening of said housing for withdrawing air from said housing and discharging the air to the atmosphere while causing outside air to enter the housing through said inlet opening and flow upwardly through the housing, air filter means associated with said fan for receiving the air withdrawn from said housing and filtering the air of particulate material prior to discharge of the air to the atmosphere, a pair of opposing gas permeable retaining walls of nonlinear zigzag configuration positioned within said upright housing and extending longitudinally thereof in closely spaced relation to one another to define an elongate generally vertically extending zigzag passageway of relatively narrow cross section adapted for receiving aggregate at the upper end thereof and for maintaining the aggregate in the form of a relatively thin continuous layer extending generally vertically in a series of oppositely directed downwardly inclined courses of travel, means cooperating with said pair of retaining walls and with the surrounding housing for directing the flow of air within said housing successively through each of said oppositely directed downwardly inclined courses of travel of the layer of aggregate so as to flow laterally back and forth through the thin layer of aggregate from opposite sides thereof to provide highly effective contact of the air with the aggregate, means for discharging aggregate from the lower end of said passageway to thus cause the layer of aggregate to move downwardly along said passageway, means defining a storage reservoir at the upper end of said zigzag passageway for maintaining the passageway filled with aggregate, means for conveying aggregate to said storage reservoir, a fuel burner provided in said upright housing and operable for heating the air flowing within said housing, said fuel burner being located adjacent the lower end of said vertically extending zigzag passageway defined by said pair of retaining walls so that portions of said zigzag passageway extend above said fuel burner for a substantial distance and into the path of the air which has been heated by the fuel burner for thus heating the aggregate in such portions of said passageway, and means provided within said housing for cooling the heated aggregate following heating thereof, said cooling means comprising a horizontally extending air permeable grate positioned beneath the lower end of said pair of retaining walls for receiving the heated aggregate which is discharged from the lower end of said passageway, means for advancing the heated aggregate laterally across said grate, and means for directing through said grate and through the aggregate positioned thereon the outside air entering said housing via said air inlet opening so as to cool the heated aggregate while preheating the air entering said housing.

12. An upright kiln as set forth in claim 11 wherein said means for directing the outside air entering said housing through said grate includes booster fan means communicatively connected to said inlet opening of said housing and to the ambient atmosphere and operable for directing the ambient outside air into said inlet opening.

13. A method of heating a solid aggregate by contact with a heated gas, said method comprising confiningly directing the aggregate downwardly through a passageway of relatively narrow cross section defined by a pair of opposing gas permeable retaining walls of nonlinear zigzag configuration to confine the aggregate in an elongate generally vertically extending relatively thin layer and wherein each of the retaining walls is formed of a series of laterally extending spaced apart slats interconnected and arranged to define inclined segmental wall portions inclined at an angle within the range of 10° to about 25° from the vertical axis and so that alternate segmental wall portions are inclined to one side of the vertical axis with the intervening segmental wall portions being inclined to the opposite side of the vertical axis and with the slats of the opposing series convergingly arranged and inclined angularly downwardly in the direction of movement of the thin layer of aggregate and positioned in overlapping relation to one another to assist in guiding the aggregate along its downward path of travel, and while directing ambient air upwardly along a predetermined sinuous path of travel passing successively through each of the oppositely directed downwardly inclined courses of travel of the layer of aggregate and successively laterally through each of the inclined segmental wall portions so as to flow repeatedly back and forth through the thin layer of aggregate from opposite sides thereof, each time entering the inclined layer from the underside thereof and emerging from the upper side of the inclined layer, with the opposing series of slats directing the flowing gas into the thin layer of aggregate in an angularly downward direction so as to assist in moving the thin layer of aggregate in its downward path of travel along the passageway and directing the gas out of the thin layer of aggregate in an inclined angularly upward direction so as to assist in removing and carrying away fine particulate material, such as dust, from the thin layer of aggregate, and while combusting a fuel in contact with upwardly flowing air to thereby heat the air which is flowing through the thin layer of aggregate and to thus heat the aggregate as it advances downwardly along the passageway.

14. A method as set forth in claim 13 wherein the step of combusting a fuel in contact with the upwardly flowing air is carried out at a location between opposite ends of the elongate passageway so that the portions of the thin layer of aggregate located above where the combustion takes place are contacted by heated air from the combustion of the fuel, with the portions of the thin layer of aggregate located below where the combustion takes place being contacted by upwardly flowing air unheated from the combustion of the fuel for thus cooling the heated aggregate while also preheating the upwardly flowing air.

15. A method as set forth in claim 13 including the further steps of receiving the heated aggregate which is discharged from the lower end of the passageway on a horizontally extending air permeable supporting surface, and advancing the heated aggregate laterally across the supporting surface while directing air upwardly through the supporting surface and through the heated aggregate positioned thereon to thereby cool the aggregate while also preheating the air which passes upwardly through the heated aggregate.

* * * * *